United States Patent [19]

Gardner

[11] 4,114,798

[45] Sep. 19, 1978

[54] INTERLOCKING COVER AND TRAY

[75] Inventor: Jeffrey M. Gardner, Wheaton, Ill.

[73] Assignee: Container Corporation of America, Chicago, Ill.

[21] Appl. No.: 846,334

[22] Filed: Oct. 28, 1977

[51] Int. Cl.[2] ..... B65D 5/42; B65D 5/64

[52] U.S. Cl. ..... 229/43; 229/32

[58] Field of Search ..... 229/32, 43

[56] References Cited

U.S. PATENT DOCUMENTS

| | | | |
|---|---|---|---|
| 2,158,578 | 5/1939 | Hoag | 229/32 |
| 2,170,714 | 8/1939 | Ferguson | 229/32 |
| 2,239,233 | 4/1941 | Hympman | 229/32 |
| 2,286,399 | 6/1942 | Becker | 229/32 |
| 2,610,783 | 9/1952 | Ochar | 229/32 UX |

*Primary Examiner*—Davis T. Moorhead

*Attorney, Agent, or Firm*—Carpenter & Ostis

[57] ABSTRACT

A collapsible interlocking cover arrangement for a two-piece telescoping container.

1 Claim, 4 Drawing Figures

INTERLOCKING COVER AND TRAY

BACKGROUND OF THE INVENTION

This invention relates to paperboard containers of the type which include telescoping tray and cover members.

It is an object of the invention to provide, in a container of the type described, an interlocking cover and tray arrangement in which the cover is collapsible.

It is a more specific object of the invention to provide, in a container of the type described, a cover having a corner construction which permits the cover member to be collapsed by infolding opposed side walls and which has inner locking flanges engageable with locking flanges on a related tray member to provide interlocking engagement between the members.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
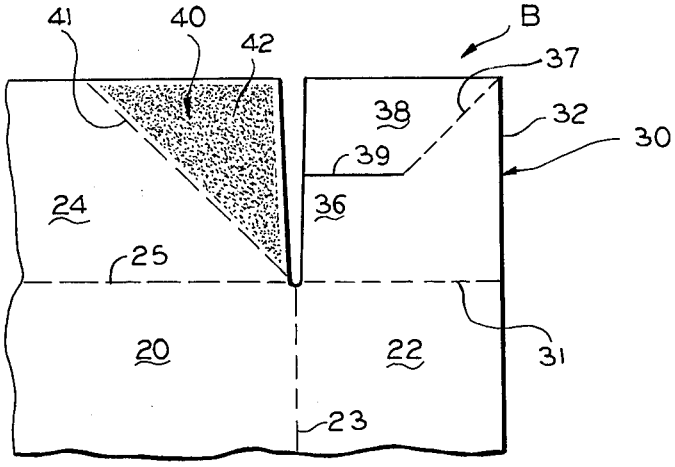
FIG. 1 is a fragmentary plan view of one corner of the blank from which the cover member illustrated in the other views may be formed.
Figure 3:
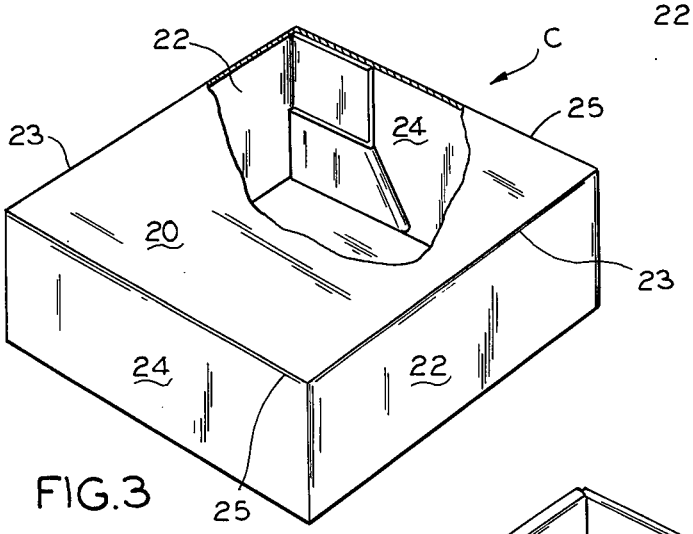
FIG. 3 is a perspective view as seen from the top and with a portion of the structure broken away of the cover member embodying features of the invention.
Figure 4:
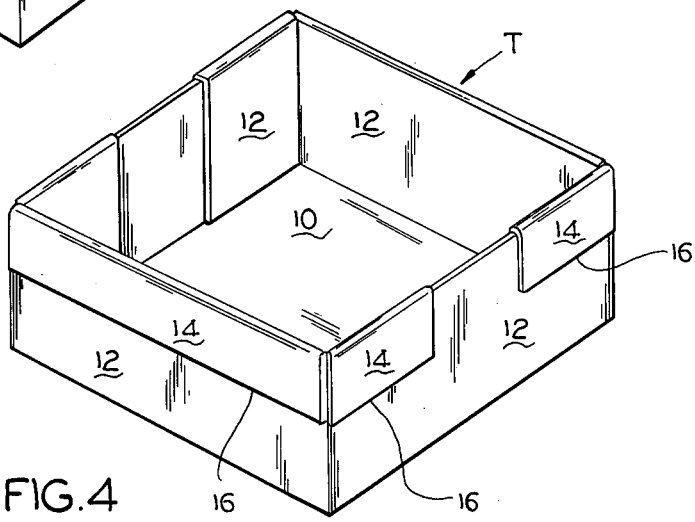
FIG. 4 is a perspective view as seen from the top of the tray member associated with the cover member illustrated in FIG. 3.

Referring now to the drawings for a better understanding of the invention, and particularly to FIGS. 3 and 4, it will be seen that the novel container of the invention includes a tray member indicated generally at T, and a telescoping cover member indicated generally at C, which cover member may be formed from a unitary blank of foldable paperboard indicated generally at B and illustrated in FIG. 1.

Again referring to FIG. 4, it will be seen that the tray includes a bottom wall 10 and pairs of side walls 12 foldably joined to each other and to opposed side edges of the bottom wall and upstanding from the latter to form a box-like structure open at the top. It will be seen that joined to or formed integrally with portions of certain of the side walls are a plurality of outwardly and downwardly folded flange elements 14 which are disposed to lie against the outer faces of upper portions of side walls 12, and which present at their lower extremeties downwardly facing abutment surfaces 16 which are adapted to mate with related surfaces of the cover member C to provide an interlocking connection between the members in a manner hereinafter described. The specific structure of the tray member T is not significant so long as it has a plurality of side walls with downwardly extending flanges which have abutment surfaces.

Referring now to FIGS. 1 and 3, it will be seen that the cover member C includes a top wall 20 having opposed pairs of first and second side walls 22 and 24 foldably joined to opposed side edges of top wall 20 along fold lines 23 and 25, respectively, which extend downwardly therefrom to form a box-like structure open at the bottom.

Each pair of side walls is joined to the other pair of side walls at the corners of the cover member by a corner flap arrangement which represents the essential feature of the invention.

The corner flap arrangement not only serves to interconnect adjacent ends of related side walls but it does so in a manner that permits certain of the side walls to be folded inwardly, thereby facilitating collapsing of the cover member into a flattened condition for shipping. This in itself is, of course, not novel in the container art; however, what is novel is to combine the conception of an infolded or collapsible feature with an interlocking feature which affords the telescoping interlocking connection between the cover and tray members.

The corner construction at each corner of the cover member, as illustrated in FIG. 1, includes a corner connecting flap 30 foldably joined along fold line 31 to an end edge of a first side wall 22. Connecting flap 30 includes a generally triangular retaining area 32 adapted to be secured to a related side wall. The triangular retaining area is disposed to lie adjacent fold line 31 and the upper edge of connecting flap 30. The remaining portion of connecting flap 30 is divided by a cut line 39 into an inner or first section 36 and a second or outer section 38. Cut line 39 extends parallel to fold line 31 between the lower edge of flap 30 and the retaining area 32 of connecting flap 30.

First section 36 is triangular in shape and second section 38 is trapezoidal in shape with its upper edge being foldably joined to retaining section 32 along a fold line 37 which extends from the upper end of cut line 39 to the free upper and outer corner of connecting flap 30.

The adjacent end of second side wall 24 is also provided with a generally triangular retaining area 40 to which adhesive 42 is applied. Retaining area 40 is of substantially the same size and shape as retaining area 32 of connecting flap 30 and is located at the upper corner of second side wall 24.

When the cover member is formed, the first and second side walls are folded downwardly at right angles to the top wall 20 with the connecting flap 30 folded inwardly at right angles to first side wall 22 so as to lie against the inside face of the adjacent end portion of related side wall 24 with the triangular retaining area 32 of flap 30 being glued in face to face relation with the retaining area 40 of second side wall 24, but with first and second sections 36 and 38 of connecting flaps 30 remaining free from attachment to second side wall 24.

Figure 2:
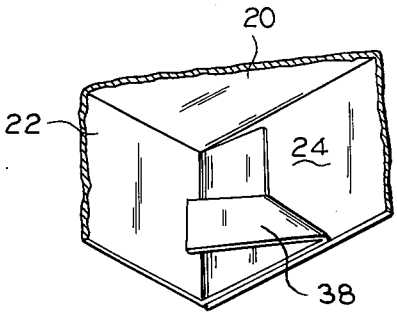
FIG. 2 is a fragmentary perspective view of a portion of the structure illustrated in FIG. 1 but shown in the erected condition.

As best seen in FIGS. 2 and 3, the fold lines 41 at each end of each second side wall 24 permit the cover member to be collapsed in a flattened condition, but when the second side walls are pulled outwardly to erect the cover member, first section 36 of each connecting flap 30 projects upwardly to lie under the top wall 20 to provide rigidity and additional support for the container in erected condition.

Still referring to FIGS. 2 and 3, it will be seen that when the container is erected, second section 38 is folded inwardly 180° about fold line 37 so as to lie in face to face relation with the lower portion of retaining section 32. When folded in this position, second section 38 becomes a locking tab presenting an upwardly facing abutment surface 50 so that when the cover member C is telescoped over the tray member T, the abutment surface 50 on each of the cover member tabs 38 engages the abutment surfaces 16 on each of the tray member flanges 14 to provide interlocking engagement between the tray and cover members.

Thus it will be appreciated that there is provided a telescoping container wherein the cover member is not only collapsible but wherein the same material used to form the collapsible connecting feature is also utilized to provide a locking feature for the container.

I claim:

1. In a collapsible, interlocking cover arrangement for a two-piece telescoping container, the combination of:

(a) a tray member including a bottom wall and opposed pairs of side walls foldably joined to each other and to said bottom wall and upstanding from the latter to form a box-like structure open at the top;

(b) certain of said tray member side walls including outer flange elements presenting downwardly facing abutments;

(c) a cover member including a top wall and opposed pairs of first and second side walls foldably joined to each other and to said top wall and depending from the latter to form a box-like structure open at the bottom;

(d) each of said cover member first side walls having triangular end portions at opposite ends thereof which are joined to the remaining portion along upwardly diverging fold lines;

(e) each of said second side walls having foldably joined to opposite ends thereof corner connecting flaps for connecting said second side walls to adjacent ends of related first side walls and which each comprise:

(i) a generally triangular first portion folded to lie against and be adhesively secured to the inner side of an adjacent triangular portion of a related first side wall to permit said cover to be collapsed by folding said triangular end portions of said first side walls along said diverging fold lines;

(ii) a portion projecting upwardly from said triangular section and being free from attachment to said first side wall for engagement with the underside of said top wall when said cover is in erected condition;

(iii) a locking tab foldably joined to a lower edge of said triangular portion and being optionally foldable on to the inner side thereof for presenting an upwardly facing abutment for engagement with a corresponding downwardly facing abutment on said tray member to provide an optional interlocking connection between said members.

* * * * *